United States Patent [19]

Hisamura et al.

[11] Patent Number: 4,948,690

[45] Date of Patent: Aug. 14, 1990

[54] ELECTROPHOTOGRAPHIC PHOTOSENSITIVE MEMBER WITH FINE SPHERICAL RESIN POWDER

[75] Inventors: Masafumi Hisamura, Kawasaki; Naoto Fujimura; Hisami Tanaka, both of Yokohama, all of Japan

[73] Assignee: Canon Kabushiki Kaisha, Tokyo, Japan

[21] Appl. No.: 462,913

[22] Filed: Jan. 11, 1990

Related U.S. Application Data

[63] Continuation of Ser. No. 352,630, May 15, 1989, abandoned, which is a continuation of Ser. No. 63,080, Jun. 17, 1987, abandoned.

[30] Foreign Application Priority Data

Jun. 19, 1986 [JP] Japan ..... 61-141329
Dec. 26, 1986 [JP] Japan ..... 61-310828

[51] Int. Cl.[5] ..... G03G 5/14

[52] U.S. Cl. ..... 430/60; 430/58; 430/64

[58] Field of Search ..... 430/60, 62, 63, 64, 430/65

[56] References Cited

U.S. PATENT DOCUMENTS 4,272,569 6/1981 Shaw et al. ..... 427/336

FOREIGN PATENT DOCUMENTS 1080308 8/1967 United Kingdom .

*Primary Examiner*—Roland E. Martin
*Attorney, Agent, or Firm*—Fitzpatrick, Cella, Harper & Scinto

[57] ABSTRACT

An electrophotographic photosensitive member comprises an intermediate layer between a support and a photosensitive layer, wherein said intermediate layer contains spherical resin fine powder.

21 Claims, 2 Drawing Sheets

ELECTROPHOTOGRAPHIC PHOTOSENSITIVE MEMBER WITH FINE SPHERICAL RESIN POWDER

This application is a continuation of application Ser. No. 352,630, filed May 15, 1989, now abandoned, which, in turn, is a continuation of application Ser. No. 063,080, filed Jun. 17, 1987, now abandoned.

BACKGROUND OF THE INVENTION

1. Field of the Invention

This invention relates to an electrophotographic photosensitive member, particularly to an improved intermediate layer which makes it possible to provide an electrophotographic photosensitive member excellent in production stability, image quality and durability of electrophotographic photosensitive member.

2. Related Background Art

Since discovery of specific organic compounds which exhibit photoconductivity, a large number of organic photoconductive materials have been developed. For example, organic photoconductive polymers such as poly-N-vinylcarbazole, polyvinylanthracene, et., low molecular weight organic photoconductive materials such as carbazole, anthracene, pyrazolines, oxathiazoles, hydrazones, polyarylalkanes, etc., or organic pigments or dyes such as phthalocyanine pigments, azo pigments, cyanine dyes, polycyclic quinone pigments, perylene type pigments, indigo dyes, thioindigo dyes or squaric acid methine dyes, etc., have been known. Particularly, organic pigments or dyes having photoconductivity can be synthesized more easily as compared with inorganic materials, and yet variation for selecting compounds exhibiting photoconductivity at an appropriate wavelength region is enlarged, and therefore, a large number of photoconductive organic pigments and dyes have been proposed. For example, as disclosed in U.S. Pat. Nos. 4,123,270, 4,247,614, 4,251,613, 4,251,614, 4,256,821, 4,260,672, 4,268,596, 4,278,747 and 4,293,628, electrophotographic photosensitive members are known using disazo pigments exhibiting photoconductivity are the charge generation substance in the photosensitive layer having the functions separated into the charge generation layer and the charge transport layer.

Since such an electrophotographic photosensitive member using an organic photoconductive material can be produced by coating with selection of an appropriate binder, productivity is extremely high to provide an inexpensive photosensitive member, and yet the photosentive wavelength region can be advantageously controlled freely by selection of the organic pigment.

Among them,, the lamination type photosensitive member obtained by lamination of a charge transport layer and a charge generation layer composed mainly of la charge generation material is more excellent in residual potential, memory, repeating characteristics, etc., as compared with other single layer type photosensitive members, particularly having advantage in improvement of sensitivity. However, in recent years, it has been desired to develop an organic photosensitive member having sensitivity, memory, repeating characteristic, durability which is equal to or getter than inorganic photosensitive member of high sensitivity such as a-Se type, CdS type, a-Si type, etc. However, under the present situation, there are a large number of unresolved problems for development of organic photosensitive members having such high performances.

Particularly, organic photosensitive members are weak in mechanical strength and, when applied to copying machines, printers, etc., pinholes, fine cracks, friction at end portions, peel-off, etc., occur in the photosensitive member to cause formation of image defects.

Also, organic photosensitive members are generally coated as thin films with 10 to 40 μm thickness on the electroconductive support, and therefore disturbance of coated films is liable to occur through the defects such as impurities, damages, striken marks, foams, etc., on the supports, thereby causing image defects.

Particularly in the case of the so called function separation type organic photosensitive member comprising a charge transport layer (CTL) laminated on a charge generation layer (CGL), it is extremely highly sensitive as compared with the former with little residual potential, while it has the drawbacks of large dark decay, and optical memory. As a countermeasure against these problems, it is required to make the charge generation layer further thinner (generally 0.01 μm to 6 μm). Accordingly, the photosensitive member is further susceptible to the influences by the defects on the support such as projections, sinks, damages, striken marks, etc., whereby various image defects are caused and no image of high quality can be obtained under the present situation.

For solving such problems, it has been attempted in recent years to provide an electroconductive layer composed mainly of an organic polymer between the support and the charge generation layer. According to this technique, image defects and lowering in image quality due to the repeating use can be reduced.

Since the electroconductive layer is generally made to have a film thickness of 10 to 50 μm, it is required to have a considerably low electrical resistance. Generally speaking, it is demanded to have a specific resistance value of $10^{14}$ Ω. cm or less, preferably $10^{12}$ Ω. cm or less, and for accomplishing the target, it has been also known to formulate organic or inorganic electroconductive substance, ionic substances, etc., in the organic polymer. Such an electroconductive layer is subject to injectability of charges, and injection of charges can be impeded by providing an adhesive layer between the electroconductive layer and the charge generation layer.

As the material to be used for the adhesive layer, organic polymers are used. However, since they have generally great electrical resistance to cause lowering in sensitivity and increase of residual potential, a thin film with a thickness of 5 μm or less, particularly 0.1 to 2 μm has been practically used.

Accordingly, the surface characteristic of the intermediate layer, particularly the surface characteristic of electroconductive layer or the surface characteristic of the adhesive layer gives great influences to the image characteristics and durability characteristics. Particularly, when no sufficient adhesive strength can be obtained between the electroconductive layer and the adhesive layer, or between the adhesive layer and the photosensitive layer, or between the electroconductive layer and the photosensitive layer, when the photosensitive member is subjected to prolonged use, pinholes, cracks, peeling, fractures, etc., from the end portions of the photosensitive layer may occur to cause remarkable lowering in image characteristics and durability characteristics.

Also, by use of a thermosetting resin as the organic polymer in the electroconductive layer, particularly resistance to friction, peeling, etc., at the end portion of the photosensitive member should be further improved, but when it is made as a smooth surface, rather adhesive strength with the adhesive layer is lowered as compared with the case of the thermoplastic resin.

Also, in recent years, development of printers, etc., a printer utilizing laser beam (LBP), LED, and a printer utilizing liquid crystal shutter, etc., have been popularly practiced, but particularly in the case of LBP, phenomenon which is called interference of laser beam occurs to form the so called interference fringe on the image.

For prevention of such interference fringe, various techniques have been investigated, and as one of the most effective techniques, there has been already known the method to roughen the surface of the support.

As the method for roughening the surface of the support, there have been known the chemical method (e.g. etching), the mechanical method (e.g. sand blast, grinding by bite), etc., but each method not only involves difficulty in pollution problem, production stability, and production cost, but also there is great variance in surface roughness and a difficulty in control of characteristic.

When the surface has become irregularly rough, injection of charges, pinholes, etc., may partially occur to cause image defects such as black dot, white dot, fog, etc., and therefore this method is still in unsatisfactory stage in practical application.

On the other hand, it has been also known to utilize an electroconductive layer. For example, it has been known to roughen the surface according to such methods as addition of coarse irregularly shaped particles into the electroconductive layer, addition of irregularly shaped fine particles with great agglomerating tendency, generation of orange peel or cell structure (Benard convection cell) on the coating by combination of solvents, formation of nonuniform interface by addition of different kinds of resins, etc.

Among them, addition of coarse irregularly shaped particles or irregularly shaped fine particles with great agglomerating tendency is an effective tehnique with relatively eacy control of the surface roughness, but also irregular coarse defects are formed on the surface, whereby great problems such as black dots, fog, etc., occur on the image under the present situation. Practically speaking, addition of coarse irregularly shaped particles with mean particle sizes or 1 to 2 μm or more can effectively roughen the surface of the electroconductive layer, but such particles are generally liable to be sedimented, and it is difficult to maintain uniform state in a coating solution formulated by the dispersion, whereby it is difficult to carry out stable production (to obtain stable surface roughness) under the present situation.

On the other hand, with irregularly shaped fine particles with a mean particle size of 0.5 μm or less, they have generally no effect of roughening the surface when dispersed uniformly in a binder solution. However, in the case of irregularly shaped particles with great agglomerating tendency, also in the case of relatively poor affinity between the particles and the binder, the coated surface can be roughened by agglomeration of the fine particles. However, in this case, it is very difficult to control the degree of agglomeration, whereby not only great defects are irregularly formed on the surface, but also agglomeration of fine particles occurs in the coating solution and it is extremely difficult to obtain production stability as a great obstacle in practical application under the present situation.

SUMMARY OF THE INVENTION

An object of the present invention is to provide an electrophotographic photosensitive member which can maintain high image quality even when prolonged usages, strong resistance against crack or peel-off of the photosensitive layer and is also excellent in adhesiveness, namely having high image quality and high durability.

Another object of the present invention is to provide an electrophotographic photosensitive member free from image defects caused by projections, sinks, damages, strike marks, etc., on the support.

A further object of the present invention is to provide an electrophotographic photosensitive member capable of preventing generation of interference fringes without causing inconveniences of image defects when laser beam is used as the light source.

The above object can be accomplished by incorporating spherical resin fine powder in the intermediate layer existing between the support and the photosensitive layer.

According to the present invention, there is provided an electrophotographic photosensitive member comprising an intermediate layer between a support and a photosensitive layer, wherein said intermediate layer contains spherical resin fine powder.

DETAILED DESCRIPTION OF THE INVENTION

The intermediate layer of the present invention is a layer existing between a support and a photosensitive layer, such as an electroconductive layer, or an adhesive layer or a laminated product of an electroconductive layer and an adhesive layer.

Figure 1:
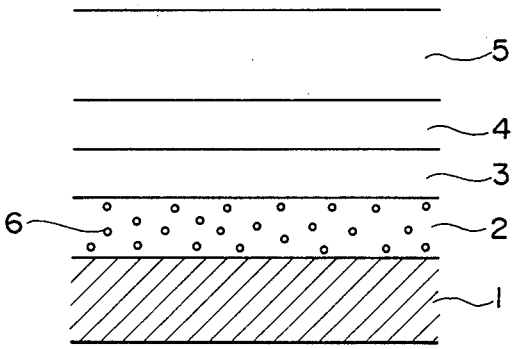
FIG. 1 is a schematic illustration of one example of the electrophotographic photosensitive member of the present invention, and spherical resin fine powder is contained particularly in the electroconductive layer of the intermediate layers.

FIG. 1 shows a preferred embodiment of the present invention having successively an electroconductive layer 2, an adhesive layer 3, a charge generation layer 4 and a charge transport layer 5 laminated on a support 1. Specifically, in the electroconductive layer 2 of the intermediate layers, spherical resin fine powder 6 is contained as uniformly dispersed therein.

Figure 2:
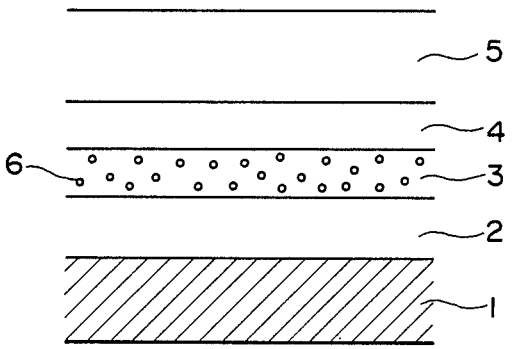
FIG. 2 is a schematic illustration of another example of the electrophotographic photosensitive member of the present invention, in which spherical resin fine powder is contained particularly in the adhesive layer of the intermediate layers.

FIG. 2 is also another preferred embodiment of the present invention, and the spherical resin fine powder 6 is contained in the adhesive layer 3 of the intermediate layers.

Figure 3:
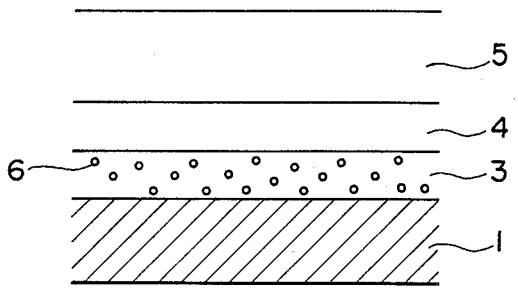
FIG. 3 shows the case in which the intermediate layer is an adhesive layer.

FIG. 3 is also another preferred embodiment of the present invention, and spherical resin fine powder 6 is contained in the adhesive layer 3 which is the intermediate layer existing between the support 1 and the charge generation layer 4.

By incorporating spherical resin fine powder in the intermediate layer, appropriate unevenness can be imparted to the surface of the intermediate layer, whereby adhesiveness between the intermediate layer and the layer laminated thereon can be enhanced. For example, in the case of FIG. 1, it is the adhesiveness between the electroconductive layer 2 and the adhesive layer 3, while in the case of FIG. 2 and FIG. 3, it is the adhesiveness between the adhesive layer 3 and the charge generation layer 4.

However, when particles irregularly shaped are added, the surface of the intermediate layer will be roughened irregularly, whereby no good adhesiveness can be obtained to cause image defect. Through triboelectric charging which occurs when irregularly shaped particles and the organic binder are dispersed in a solvent, charges are localized on a part of the particle surface to give the result that agglomerated product mutually between particles is formed, whereby the coated surface will be roughened nonuniformly. As the result, on the coating laminated on the intermediate layer, strange subject, sink, repelling, agglomeration, etc., are generated to cause partial image defects. Also, fine strange subject is generated as a whole (which become white dots, black dots on the image) to lower the image quality.

However, in the case of spherical particles, the charges are not localized on a part of the particle surface to cause no agglomeration mutually between particles, whereby uniform coated surface without local defects can be obtained.

Further, resin powder is more excellent in affinity for an organic binder as compared with inorganic powder, and its specific gravity is relatively lighter, and therefore there is the effect of improving further uniformity of the dispersion, stability of the dispersion and uniformity of coated film.

Figure 4:
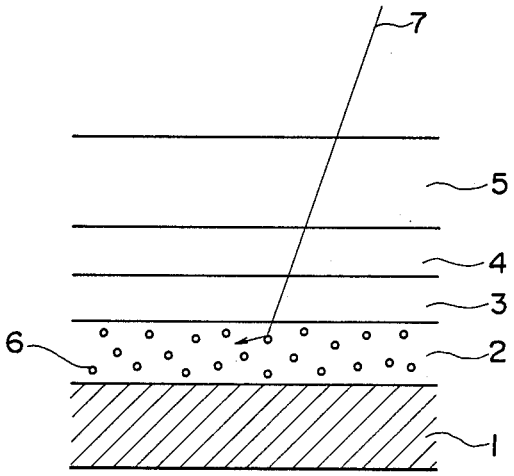
FIG. 4 is a schematic illustration showing diffusion of spherical resin fine powder by irradiation of incident light.

Also, in the electrophotographic method by use of laser beam as the light source, when image formation is effected by line scanning of laser beam, although there is no problem in line image such as letters, density irregularity appears in shape of interference fringe in the case of solid image. However, by incorporating spherical resin fine powder in the intermediate layer as in the present invention, such interference fringe can be prevented. For example, as shown in FIG.4, the light 7 transmitted through the photosensitive layer comes against the spherical resin fine powder 6 in the intermediate layer, and its reflected light creates phase difference to prevent generation of density irregularity shaped in interference fringe.

The spherical resin fine powder to be incorporated in the intermediate layer should preferably have a mean particle size of 0.6 to 6 μm. If the mean particle size is smaller than 0.6 μm, the roughening effect of the coated surface cannot be obtained when affinity between the fine particles and the binder is good. On the other hand, when affinity between the fine particles and the binder is poor, not only stability and productivity of the coating solution are lowered through agglomeration between fine particles, but also irregular unevenness is increased on the coated surface to cause remarkable lowering in image quality. On the contrary, if the mean particle size exceeds 6 μm, the roughness of the coated surface becomes greater, and fine repelling, strange subject, etc., are generated on the coated film laminated thereon, whereby defects such as white dots, black dots, etc., may be caused to be generated on the image. Particularly, in connection with the film thickness, when the layer containing the spherical resin fine powder is an electroconductive layer, the mean particle size of the spherical resin fine powder should preferably be 1 μm to 4 μm, while in the case of an adhesive layer, it should preferably be 0.6 μm to 2 μm.

Measurement of the mean particle size can be performed according to the method as described below. The spherical resin fine powder is observed by a scanning type electron microscope, the diameters of the respective particles are measured and an average value of 20 points is calculated. These operations are repeated three times, and further an average value is calculated to give the mean particle size. However, when the distribution of the particle sizes of the powder is great, it is necessary to make them uniform by shaking well previously.

The spherical resin fine powder in the present invention should have a spherical degree of 0.5 or more, preferably 0.8 or more in terms of the ratio of the diameter of the minimum circumscribed circle to the maximum inscribed circle of the particle when the diameter of the circumscribed circle is made 1. Accordingly, true spherical or ellipsoidal shape is preferred, and irregular shaped particles are not suitable.

The dispersing medium having an organic binder dissolver in a solvent should have a specific gravity which is almost included within the range of 0.8 to 1.5. Accordingly, the dispersing material (spherical resin fine powder) to be dispersed in said dispersing medium may have a specific gravity of 0.7 to 1.7, particularly preferably 0.9 to 1.5.

When the specific gravity is smaller than 0.7, or greater than 1.7, uniformity and stability of the dispersion cannot be sufficiently obtained in either case, whereby the coated film may be roughened irregularly to cause lowering in image quality. Accordingly to the method of the present invention, the surface of the intermediate layer can be controlled uniformly to the targeted surface roughness without lowering image quality, and an organic photosensitive member having high sensitivity as well as high image quality and high durability can be provided.

The spherical resin fine powder is required as a premise to be insoluble in a solvent. For example, when a ketone or ester solvent is used, it is necessary to use a polyamide or polyolefin type resin powder is combination.

When the spherical resin fine powder is a setting type resin, it is insoluble in a solvent in most cases, whereby the above restriction can be escaped.

As the spherical resin fine powder of the present invention, fine powder comprising a thermoplastic resin or a curing type resin can be used.

Examples of the thermoplastic resin may include acrylic resins, styrene resins, polycarbonate resins, polyester resins, polyamide resins, etc. As the acrylic resin, there may be employed polymers of monomers such as methyl methacrylate, ethyl methacrylate, isopropyl methacrylate, phenyl methacrylate, methyl acrylate, ethyl acrylate and the like or copolymers of these monomers with other monofunctional monomers.

As the styrene resins, there may be employed polymers of monomers such as styrene, methyl styrene, chlorostyrene and the like or copolymers of these monomers with other monofunctional monomers.

As the polycarbonate resins, there may be employed polycondensates of bisphenol A with phosgene or polycondensates or bisphenol Z with phosgene, etc.

As the polyester resin, there may be employed polycondensates of dicarboxylic acids such as terephthalic acid, isophthalic acid, orthophthalic acid, etc., with ethylene glycol, propylene glycol, glycerine or copolycondensates of these.

As the polyamide resins, polycondensates or $\epsilon$-aminocarproic acid, or $\omega$-aminoundecanoic acid or polycondensates of hexamethylenediamine with adipic acid, etc., may be employed.

As the curing type resin, for example, silicone resins, melamine resins, urea resins, acrylic resins, styrene resins, etc., may be included.

As the silicon resins, heat vulcanization type silicone rubbers, room temperature curing type silicone rubbers, silicone resins, modified silicone resins may be used.

As the melamine resin, condensates of melamine with cyanuric acid, polycondensates of melamine with formaldehyde may be employed.

As the urea resin, polycondensates of methylolurea may be used.

As the acrylic resins, there may be employed copolymers of monofunctional monomers such as methyl methacrylate, ethyl methacrylate, isopropyl methacrylate, phenyl methacrylate, methyl acrylate, ethyl acrylate, etc., with polyfunctional monomers such as divinylbenzene, trivinylbenzene, etc. As the styrene resins, there may be employed copolymers of monofunctional monomers such as styrene, methylstyrene, chlorostyrene, etc., with polyfunctional monomers such as divinylbenzene, trivinylbenzene, etc.

Examples of the resins to be used for the spherical resin fine powder are shown above, and among them silicone resins, melamine resins, polyamide resins, acrylic resins, and styrene resins are preferred. Further, particularly preferred with respect to dispersion stability, mechanical strength, solvent resistance, etc., are silicone resins.

The surface roughness of the intermediate layer targeted by the present invention may be suitably 0.5 to 4 $\mu$m, particularly 0.7 to 2 $\mu$m. Also, it is important that the maximum height (maximum roughness) should be 6 $\mu$m or less.

The surface roughness is measured by use of a universal shape measuring instrument (Model SE-3C, produced by Kosaka Kenkyusho), and is represented in terms of an average roughness of ten points (JISB0601). On the other hand, the maximum height (JISB0601) is represented in terms of the value from which abnormal values small in frequency are removed.

In the present invention, the amount of the spherical resin fine powder added may be 0.5 to 30 wt. %, preferably 2 to 10 wt. % based on the total weight of the intermediate layer. If the amount added is less than 0.5 wt. %, durability and mechanical strength of the photosensitive member are not sufficient, while with an amount over 30 wt. %, image defects will be formed.

The basic constitution of the electrophotographic photosensitive member of the present invention comprises a support, an intermediate layer and a photosensitive layer successively from the lower layer, and the effect is most marked in a constitution of the so-called function separation type of the photosensitive member wherein the photosensitive layer comprises a charge generation layer (CGL) and a charge transport layer (CTL), in the case when CGL and CTL are laminated in this order. However, when the photosensitive layer is formed by laminating CTL and CGL in this order, even when adhesion between CTL and a intermediate layer may be particularly bad, the present invention can be an effective technique.

As the support to be used in the present invention, various materials and shapes such as sheets, belts, cylinders, etc., of metals, plastics, papers, etc., may be considered, but electroconductive supports as shown below may be generally employed.

For example, there can be used aluminum, aluminum allyos, copper, zinc, stainless steel, vanadium, molybdenum, chromium,, titanium, nickel, indium, gold or platinum, or otherwise plastics having layers formed by coating according to the vacuum vapor deposition method with aluminum, aluminum alloy-indium oxide, tin oxide, indium oxide, tin oxide alloys, etc., supports coated on plastics with electroconductive particles together with a suitable binder, supports of plastics or papers impregnated with electroconductive particles, or plastics having electroconductive polymers, etc.

Next, the layers of the intermediate layer et seq are formed by coating of solutions or dispersions in solvents in most cases. Formation of layers by coating can be practiced by dip coating, spray coating, spinner coating, bead coating, meyer nad coating, blade coating, roller coating, curtain coating, etc.

The electroconductive layer to be used in the present invention has at least a binder and an electroconductive layer should be set at an optimum value depending on the surface state (damage, unevenness, strike mark, etc.), and can be set broadly at from about 0.5 to 100 $\mu$m, but ordinarily from 10 to 50 $\mu$m.

As the binder in the electroconductive layer to be used in the present invention, there can be included polyarylate resin, polysulfone resin, polyamide resin, acrylic resin, acrylonitrile resin, methacrylic resin, vinyl chloride resin, vinyl acetate resin, phenol resin, epoxy resin, polyester resin, alkyd resin, polycarbonate, polyurethane or copolymer resin containing two or more recurring units of these resins, such as styrene-butadiene copolymer, styrene-acrylonitrile copolymer, styrene-maleic acid copolymer, etc.

Particularly, thermosetting resins such as acrylic resin, methacrylic resin, phenolic resin, styrene resin, polyurethane resin, epoxy resin, alkyd resin, polyester resin, silicone resin, melamine resin and copolyers of these and curable rubbers are preferred. As the electroconductive substance to be dispersed in the electroconductive layer, there can be included metal powders such as aluminum, tin, silver, etc., electroconductive pigments composed mainly of carbon powder or metal oxides such as titanium oxide, barium sulfate, zinc oxide or tin oxide, polyacetylene, polyphenylene oxide, a polypyrrole, polythiophene and substances doped with $LiClO_4$, metal phthalocyanine (M-PC), polymers containing M-PC in the main chain and substances of these doped with $I_2$, TCNQ (tetracyanoquinodimethane), substances of polymers having —$NH_2$, —COOH, —OH coordinated with metal ions (polymeric metal complexes), quaternary ammonium salts, quaternary chloride polymers, various ionic substances, etc. Also, light absorbers can be contained in the electroconductive layer.

Further, the electroconductive layer can contain surface energy lowering agents such as silicone oil, various surfactants, etc., and uniform coated surface with small coating defect can be obtained. As the method for dispersing electroconductive powder in the resin, conventional methods by means of roll mill, ball mill, vibrating ball mill, attritor, sand mill, colloid mill, etc., can be used.

The adhesive layer can impede injection of carriers (charges) from the support or the electroconductive layer to the photosensitive layer, and its electrical resistance is demanded to be 1/50 or less as compared with the photosensitive layer. Generally speaking, most of the adhesive layers have high electrical resistance, and therefore the film thickness may be appropriately 5 μm or less, preferably 0.1 μm to 2 μm.

As the material to be used for the adhesive layer, there may be included, for example, casein, gelatin, polyamide (nylon 6, nylon 66, nylon 610, copolymerized nylon, alkoxymethylated nylon), polyurethane, polyvinyl alcohol, nitrocellulose resin, ethylene-acrylic acid copolymer resin, phenol resin, acrylic resin, polyester, polyether, etc.

The charge generation layer is formed by coating of a coating liquid having a charge generation substance dispersed in a suitable binder resin, followed by drying.

The charge generation substance to be used in the present invention is a pigment, but even a dye soluble in a solvent can be used by selecting a suitable solvent for formation into particles.

As the charge generation substance, there may be included phthalocyanine type pigments, anthanthrone pigments, dibenzpyrene pigments, pyranthrone pigments, azo pigments, indigo pigments, quinacridone type pigments, cyanine type pigments, squarium type pigments, azulenium salt compounds, pyrylium, thiopyrylium type dyes, xanthene type colorants, quinoneimine type colorants, triphenylmethane type colorants, styryl type colorants, etc.

The charge transport layer may be formed by coating of a coating solution of a charge transport substance dissolved in a resin having film forming property, followed by drying. Examples of such charge transport substance may include electron attracting substances such as chloroanil, bromoanil, tetracyanoethylene, tetracyanoquinodimethane, 2,4,7-trinitro-9-fluorenone, 2,4,5,7-tetranitro-9-fluorenone, 2,4,7-trinitro-9-dicyanomethylene-fluorenone, 2,4,5,7-tetranitroxanthone, 2,4,8-trinitrothioxanthone, etc., or these electron attracting substances formed into molecules, or positive hole transport substances such as pyrene, N-ethylcarbazole, N-isopropylcarbazole, N-methyl-N-phenylhydrazino-3-methylidene-9-ethylcarbazole, N,N-diphenylhydrazino-3-methylidene-9-ethylcarbazole, N,N-diphenylhydrazino-3-methylidene-10-ethylphenothiazine, N,N-diphenylhydrazino-3-methylidene-10-ethylphenoxazine, p-diethylaminobenzaldehyde-N,N-diphenylhydrazone, p-diethylaminobenzaldehyde-N-α-naphthyl-N-phenylhydrazone, p-pyrrolidinobenzaldehyde-N,N-diphenylhydrazone, 1,3,3-trimethylindolenine-ω-aldehyde-N,N-diphenylhydrazone, p-diethylbenzaldehyde-3-methylbenzthiazolinone-2-hydrazone, and other hydrazones, 2,5-bis(p-diethylaminophenyl)-1,3,4-oxadiazole, 1-phenyl-3-(p-diethylaminostyryl)-5-(p-diethylaminophenyl) pyrazoline, 1-[quinolyl(2)]-3-(p-diethylaminostyryl)-5-(p-diethylaminophenyl) pyrazoline, 1-[pyridyl(2)]-3-(p-diethylaminostyryl)-5-(p-diethylaminophenyl)pyrazoline, 1-[6-methoxypyridyl(2)]-3-(p-diethylaminostyryl)-5-(p-diethylaminophenyl)pyrazoline, 1-[pyridyl(3)]-3-(p-diethylaminostyryl)-5-(p-diethylaminophenyl)pyrazoline, 1-[lepidyl(2)]-3-(p-diethylaminostyryl)-5-(p-diethylaminophenyl)pyrazoline, 1-[pyridyl(2)]-3-(p-diethylaminostyryl)-4-methyl-5-(p-diethylaminophenyl)-pyrazoline, 1-[pyridyl(2)]-3-(α-methyl-p-diethylaminostyryl)-5-(p-diethylaminophenyl)pyrazoline, 1-phenyl-3-(p-diethylaminostyryl)-4-methyl-5-(p-diethylaminophenyl)pyrazoline, 1-phenyl-3-(α-benzyl-p-diethylaminostyryl)-5-(p-diethylaminophenyl)pyrazoline, spiropyrazoline and other pyrazolines; 2-(p-diethylaminostyryl)-6-diethylaminobenzoxazole, 2-(p-diethylaminophenyl)-4-(p-dimethylaminophenyl)-5-(2-chlorophenyl)oxadiazole and other oxazole type compounds; 2-(p-diethylaminostyryl)-6-diethylaminobenzothiazole and other thiazole type compounds: bis(4-diethylamino-2-methylphenyl)-phenylmethane and other triarylmethane type compounds; 1,1-bis(4-N,N-diethylamino-2-methylphenyl)heptane, 1,1,2,2-tetrakis(4-N,N-dimethylamino-2-methylphenyl)ethane and other polyarylalkanes, α-phenyl-4-N,N'-diphenylaminostilbene, N-ethyl-3(α-phenylstyryl)carbazole-4-N,N'-dibenzylamino-9-fluorenylidene and other styryl type compounds, triphenylamine, poly-N-vinylcarbazole, polyvinylpyrene, polyvinylanthracene, polyvinylacridine, poly-9-vinylphenylanthracene, pyrene-formaldehyde resins, ethylcarbazoleformaldehyde resins, etc.

Also, these charge transport substance can be used as a combination of two or more kinds.

The binder may include polyarylate resin, polysulfone resin, polyamide resin, acrylic resin, acrylonitrile resin, methacrylic resin, vinyl chloride resin, vinyl acetate resin, phenyl resin, epoxy resin, polyester resin, alkyd resin, polycarbonate, polyurethane or copolymer resins containing two or more of the recurring unit of these resins, such as styrene-butadiene copolymer, styrene-acrylonitrile copolymer, styrene-maleic acid copolymer, etc.

The film thickness of the photosensitive layer may be 5 to 50 μm, preferably 10 to 30 μm, but in the case of the function separation type in which CGL and CTL are laminated in this order, the thickness of CGL may be preferably 0.01 to 5 μm, preferably 0.05 to 3 μm, and that of CTL may be 5 to 50 μm, preferably 10 to 30 μm.

If desired, a protective layer comprising an organic binder as the main component may be provided as the uppermost layer with a film thickness of 0.5 to 10 μm.

Also, in the uppermost layer, lubricating substances, UV-ray absorbers, and antioxidants may be included.

The photosensitive member for electrophotography of the present invention is generally applicable for electrophotographic devices such as copying machine, LBP (laser beam printer), LED printer, LCD printer (liquid crystal shutter system printer), microreader printer, etc., and further applicable broadly for devices in which electrophotographic technology is applied such as display, recording, light printing, printing plate, facsimile, etc.

EXAMPLE 1

100 parts by weight of an electroconductive titanium oxide powder (produced by Titanium Kogyo), 100 parts by weight of titanium oxide powder (produced by Sakai Kogyo), 125 parts by weight of a phenol resin (produced by Dai Nippon Ink Co., Plyophen), 0.02 parts by weight of a silicone type surfactant (Toray silicone) and 20 parts by weight of spherical silicone resin fine powder (polymethylsilsesquioxane, specific gravity 1.3, mean particle size 1.2 μm) were mixed with solvents of 50 parts by weight of methanol and 50 parts by weight of methyl cellosolve, and then the mixture was dispersed by means of a sand mill over 6 hours. The dispersion was applied on an aluminum cylinder of 80 mm in diameter and 360 mm in length according to the dipping method as shown in FIG. 1, thermally cured at 150° C. over 30 minutes to provide an electroconductive layer with a film thickness of 20 μm.

Next, 2 parts (parts by weight, hereinafter the same) of a copolymer nylon resin (trade name: Amilan CM8000, produced by Toray) and 8 parts of a copolymer nylon resin (trade name; Toresin EF-30T, produced by Teikoku Kagaku) were dissolved in a mixture of 60 parts of methanol and 40 parts by butanol, and the solution was applied by dipping on the above electroconductive layer to provide an adhesive layer with 1 μm thickness.

Next, 10 parts of a disazo pigment having the following structural formula:

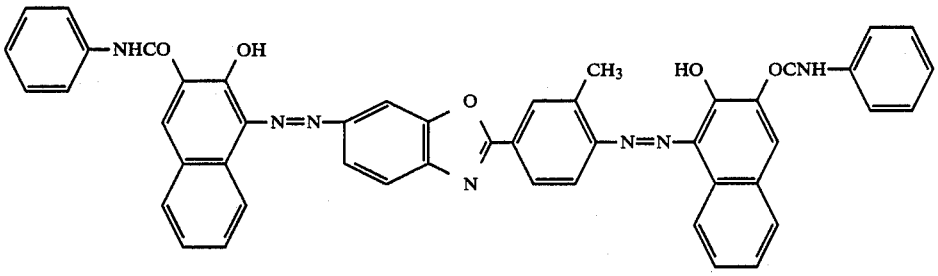

6 parts of a cellulose acetate butyrate resin (trade name: CAB-381, produced by Eastman Kagaku) and 60 parts of cyclohexanone were dispersed by means of a sand mill device by use of glass beads of 1 mm in diameterfor for 20 hours. To the dispersion were added 100 parts of methyl ethyl ketone, and the resultant mixture was applied by dipping on the above adhesive layer, followed by drying under heating at 100° C. for 10 minutes to provide a charge generation layer with a coated amount of 0.1 g/m$^3$ thereon.

Subsequently, 10 parts of a hydrazone compound having the following structural formula:

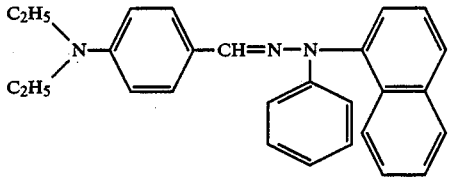

and 15 parts of a polycarbonate resin (trade name: Panlite L-1250, produced by Teijin Kasei K.K.) were dissolved in 80 parts of dichloromethane, the solution was applied on the above charge generation layer and dried in hot air at 100° C. for 1 hour to form a charge transport layer with a thickness of 20 μm.

This photosensitive member No. 1 was mounted on a copying machine (NP-3525, produced by Canon) to effect image formation. The image qualities at the initial stage and after successive copying of 50000 sheets were shown in Table 1.

Also, the dark place potential and exposure potential of this photosensitive member were measured at the initial stage and after successive copying of 50,000 sheets, and stability of potential was shown in Table 1. The exposure quantity is 3 lux.sec.

Also, the surface roughness of only the electroconductive layer, and uniformity of the coated film as the photosensitive member were observed to obtain the results shown in Table 1.

EXAMPLE 2

An electrophotographic photosensitive member No. 2 was prepared according to the same method as in Example 1 except for changing the mean particle size of the spherical silicone resin fine powder to 3.8 μm in the electroconductive layer of Example 1.

Evaluation of the photosensitive member was conducted similarly as in Example 1 to obtain the results shown in Table 1.

COMPARATIVE EXAMPLE 1

An electrophotographic photosensitive member No. 3 was prepared according to the same method as in Example 1 except for omitting the spherical silicone resin fine powder in the electroconductive layer of Example 1.

Evaluation of the photosensitive member was conducted similarly as in Example 1 to obtain the results shown in Table 1.

COMPARATIVE EXAMPLE 2

An electrophotographic photosensitive member No. 4 was prepared according to the same method as in Example 1 except for changing the mean particle size of the spherical silicone resin fine powder to 0.5 μm in the electroconductive layer of Example 1.

Evaluation of the photosensitive member was conducted similarly as in Example 1 to obtain the results shown in Table 1.

COMPARATIVE EXAMPLE 3

An electrophotographic photosensitive member No. 5 was prepared according to the same method as in Example 1 except for changing the mean particle size of the spherical silicone resin fine powder to 7 μm in the electroconductive layer of Example 1.

Evaluation of the photosensitive member was conducted similarly as in Example 1 to obtain the results shown in Table 1.

COMPARATIVE EXAMPLE 4

An electrophotographic photosensitive member No. 6 was prepared according to the same method as in Example 1 except for using zinc oxide fine powder (zinc oxide, irregular needle crystal, specific gravity 5.6, mean particle size 3.8 μm) in place of the spherical silicone resin fine powder in the electroconductive layer of Example 1.

The evaluation of the photosensitive member was conducted similarly as in Example 1 to obtain the results as shown in Table 1.

COMPARATIVE EXAMPLE 5

An electrophotographic photosensitive member No. 7 was prepared according to the same method as in Example 1 except for using silicone resin fine powder with a spherical degree of 0.3 in place of the spherical silicone resin fine powder in the electroconductive layer of Example 1.

Evaluation of the photosensitive member was conducted similarly as in Example 1 to obtain the results shown in Table 1.

As the result of these experiments, the electrophotographic photosensitive member having an electroconductive layer formulated with spherical resin fine powder of mean particle size of 1.2 μm, 3.8 μm was found to be of high image quality, excellent in durability (image defect by crack of the photosensitive member, peeling from the end portion, white dot, pinhole, black dot, fog, etc., based on fine crack) without image defect (white dot, black dot, fog, etc.) and also have excellent production stability without causing agglomeration, sedimentation, etc., of the coating solution.

On the other hand, as shown in Comparative example 4, when zinc oxide particles of inorganic particles are used, inorganic particles are generally non-spherical in most cases with insufficient affinity (dispersibility) for the binder solution. Moreover, since the shape is non-spherical, the coated surface is nonuniform with coarseness, and problems such as low resolution, presence of white dot, fog, etc., were also recognized in image quality. Also, in successive copying test of 50,000 sheets, image defects such as white dot, black dot, fog, etc., became increased, with the image density being also lowered. Further, the coating solution suffered from sedimentation of particles, nonuniformity in liquid concentration within 3 days, thus exhibiting remarkably poor production stability.

On the other hand, even if the particles may be silicone resin, those with a mean particle size of 0.5 μm or a spherical degree of 0.3 were found to be poor in stability of the coating solution (thus involving problems in production stability and stability of the characteristics), whereby agglomeration occurred in the coating solution within 2 to 3 weeks, and also white dot, black dot, pinholes were generated in successive copying. Further, although not shown in the Table, agglomeration occurred in the coating solution within one week when the mean particle size was 0.3 μm.

Also, when the mean particle size was 7 μm, difficulties were encountered from the initial stage in resolution, image defects (white dot, fog), and in successive copying test of 50,000 sheets, and image defects (white dot, black dot) were increased, with generation of pinholes being also recognized.

EXAMPLE 3

In the electroconductive layer in Example 1, 30 parts of a styrene resin fine powder (polystyrenedivinylbenzene copolymer resin, specific gravity 1.0, mean particle size 1.0 μm) were added in place of the silicone resin fine powder to form an electroconductive layer.

Next, 10 parts of a polyester resin (trade name: Vylon 200, produced by Toyobo) were dissolved in 200 parts of methyl ethyl ketone and the solution was applied by dipping on the above electroconductive layer to provide an adhesive layer with a thickness of 0.5 μm.

Next, in the charge generation layer in Example 1, 6 parts of a butyral resin (trade name: Eslec BL-S, produced by Sekisui Kagaku) were added in place of the cellulose acetate butyrate resin to form a charge generation layer.

The charge transport layer was prepared in entirely the same manner as in Example 1 to obtain an electrophotographic photosensitive member No. 8.

Evaluation of the photosensitive member was practiced similarly as in Example 1 to obtain the results shown in Table 2.

COMPARATIVE EXAMPLE 6

In the electroconductive layer in Example 3, the styrene resin fine powder was omitted, following otherwise the same procedure as in Example 1 to prepare an electrophotographic photosensitive member No. 9.

Evaluation of the photosensitive member was practiced similarly as in Example 1 to obtain the results shown in Table 2.

EXAMPLE 4

100 parts by weight of an electroconductive carbon paint (Dotite, produced by Fujikura Kasei), 50 parts by weight of a melamine resin (Super Beckamin, produced by Dainippoin Ink), 5 parts by weight of aluminum oxide powder (mean particle size 5 μm) and 15 parts by weight of spherical melamine resin fine powder (melamine-formaldehyde copolymer, specific gravity 1.4, mean particle size 3.0 μm) were mixed with 100 parts by weight of toluene as the solvent, and then the mixture was dispersed by a ball mill over 6 hours. The dispersion was applied on an aluminum cylinder by the dipping method, thermally cured at 150° C. for 30 minutes to provide an electroconductive layer with a film thickness of 20 μm.

Next, as the polyurethane resin 5 parts by weight of Nipporane 800 (produced by Nippon Polyurethane K.K.) and 5 parts of Coronate 2507 (produced by Nippon Polyurethane K.K.) together with 0.01 part of a curing agent (dibutyltin laurate) were dissolved in 150 parts of methyl ethyl ketone, and the solution was applied by dipping on the above electroconductive layer, and dried under heating at 150° C. for 30 minutes to obtain an adhesive layer.

Next, in the charge generation layer in Example 1, 6 parts of an acrylic resin (trade name: Dianal BR-52, Mitsubishi Rayon) were added in place of the cellulose acetate butyrate resin to form a charge generation layer.

The charge transport layer was prepared in the same manner as in Example 1 to obtain an electrophotographic photosensitive member No. 10.

Evaluation of the photosensitive member was conducted similarly as in Example 1 to obtain the results shown in Table 2.

COMPARATIVE EXAMPLE 7

In the electroconductive layer in Example 4, the mean particle size of the melamine resin fine powder was changed to 7.1 μm, following otherwise the same procedure as in Example 1, an electrophotographic photosensitive member No. 11 was prepared.

Evaluation of the photosensitive member was conducted similarly as Example 1 to obtain the results shown in Table 2.

COMPARATIVE EXAMPLE 8

Except for providing no electroconductive layer in Example 1, the adhesive layer, the charge generation layer and the charge transport layer were successively formed in the same manner as in Example 1 to form an electrophotographic photosensitive member No. 12.

Evaluation of the photosensitive member was conducted similarly as in Example 1 to obtain the results shown in Table 2.

EXAMPLE 5

100 parts by weight of an electroconductive titanium oxide powder (produced by Titanium Kogyo), 100 parts by weight of titanium oxide powder (produced by Sakai Kogyo), 125 parts by weight of a phenol resin (Plyophen, produced by Dainippon Ink), 0.02 parts of a silicone type surfactant (Toray silicone) and 20 parts by weight of a silicone resin fine powder (polymethylsilsesquioxane, specific gravity 1.3, mean particle size 2.5 μm) were mixed with a solvent of 50 parts by weight of methanol and 50 parts by weight of methyl cellosolve, and then the mixture was dispersed by a ball mill over 6 hours. The dispersion was applied on an aluminum cylinder of 60 mm in diameter and 260 mm in length according to the dipping method as shown in FIG. 1, thermally cured at 150° C. for 30 minutes to provide an electroconductive layer with a film thickness of 20 μm.

Next, 2 parts of a copolymer nylon resin (trade name: Amilan CM8000, produced by Toray) and 8 parts of a copolymer nylon resin (trade name: Toresin EF-30T, produced by Teikoku Kagaku) were dissolved in a mixture of 60 parts of methanol and 40 parts of butanol, and applied by dipping on the above electroconductive layer to provide an adhesive layer with a thickness of 1 μm.

Next, 10 parts of a disazo pigment having the following structural formula, 6 parts of an acrylic resin (Dianal BR-80, produced by Mitsubishi Rayon) and 60 parts of cyclohexanone were dispersed by a sand mill device using glass beads of 1 mm in diameter for 20 hours.

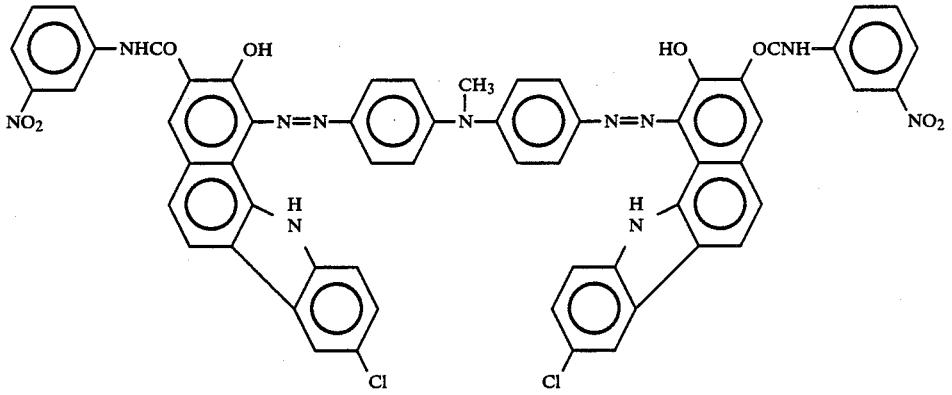

To the dispersion were added 2700 parts by weight of methyl ethyl ketone, and the mixture was applied by dipping on the above polyamide resin layer, followed by drying under heating at 50° C. for 10 minutes to provide a charge generation layer with a coated amount of 0.15 g/m².

Next, 10 parts of a hydrazone compound having following structural formula:

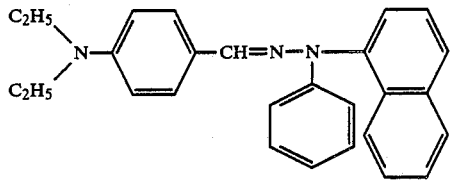

and 15 parts of a polycarbonate resin (trade name: Panlite L-1250: produced by Teijin Kasei K.K.) were dissolved in 80 parts of dichloromethane. The solution was applied on the above charge generation layer and dried in hot air at 100° C. for 1 hour to form charge transport layer with a thickness of 20 μm.

Also, the surface roughness of only the electroconductive layer, and uniformity of the coated film as the photosensitive member were observed to obtain the results shown in Table 3.

This photosensitive member No. 13 was mounted on a laser printer (LBP-8, produced by Canon) with the use of a semiconductor laser of oscillation wavelength 780 nm as the light source to effect image formation. The image qualities at the initial stage and after successive copying of 50,000 sheets are shown in Table 3.

In the initial image, no interference fringe inherent in LBP was recognized, and good results were obtained with good resolution and substantially without image defect.

Further, no abnormality was recognized in successive copying test of 50,000 sheets.

Also, dark potential and exposure potential of this photosensitive member were measured at the initial stage and after successive copying of 50,000 sheets, and the stability of potential was shown in Table 3. The exposure dose was 3 μJ/cm².

EXAMPLE 6

In the electroconductive layer in Example 5, the mean particle size of the spherical silicon resin fine powder was changed to 4.0 μm, following otherwise the same procedure as in Example 5 to prepare an eletrophotographic photosensitive member No. 14.

Evaluation of the photosensitive member was also conducted similarly as in Example 5 to obtain the results shown in Table 3.

COMPARATIVE EXAMPLE 9

An electrophotographic photosensitive member No. 15 was prepared in the same manner as in Example 5 except for omitting the spherical silicone resin fine powder in the electro-conductive layer in Example 5.

Evaluation of the photosensitive member was conducted similarly as in Example 5 to obtain the results shown in Table 3.

In the initial image, interference fringe by interference with the laser beam was generated, and the uniformity of the image was remarkably inferior. Also, in successive copying test, image defects occurred based on crack and peeling of the photosensitive layer.

COMPARATIVE EXAMPLE 10

An electrophotographic photosensitive member No. 16 was prepared in the same manner as in Example 5 except for changing the mean particle size of the spherical silicone resin fine powder to 0.4 μm in the electroconductive layer in Example 5.

Evalution of the photosensitive member was conducted similarly as in Example 5 to obtain the results shown in Table 3.

COMPARATIVE EXAMPLE 11

An electrophotographic photosensitive member No. 17 was prepared in the same manner as in Example 5 except for changing the mean particle size of the spherical silicone resin fine powder to 8.0 μm in the electroconductive layer in Example 5.

Evalution of the photosensitive member was conducted similarly as in Example 5 to obtain the results shown in Table 3.

COMPARATIVE EXAMPLE 12

An electrophotographic photosensitive member No. 18 was prepared in the same manner as in Example 5 except for using zinc oxide fine powder (zinc oxide, specific gravity 5.6, mean particle size 4.0 μm) in place of the spherical silicone resin fine powder in the electroconductive layer in Example 5.

Evaluation of the photosensitive member was conducted in the same manner as in Example 5 to obtain the result shown in Table 3.

EXAMPLE 7

In the electroconductive layer in Example 5, 30 parts of a spherical acrylic resin fine powder (polymethyl methacrylate, specific gravity 1.1, mean particle size 1.5 μm) were added in place of the spherical silicon resin fine powder to form an electroconductive layer.

Next, 10 parts of a polyester resin (trade name: Vylon 200, produced by Toyobo) were dissolved in 200 parts of methyl ethyl ketone, and the solution was applied by dipping on the above electroconductive layer to provide an adhesive layer with a thickness of 0.5 μm.

The charge generation layer and the charge transport layer were prepared in the same manner as in Example 5 to obtain an electrophotographic photosensitive member No. 19.

Evaluation of the photosensitive member was conducted in the same manner as in Example 5 to obtain the results shown in Table 4.

COMPARATIVE EXAMPLE 13

An electrophotographic photosensitive member No. 20 was prepared in the same manner as in Example 5 except for omitting the spherical acrylic resin fine powder in the electroconductive layer in Example 7.

Evaluation of the photosensitive member was conducted in the same manner as in Example 5 to obtain the results shown in Table 4.

EXAMPLE 8

100 parts by weight of an electroconductive carbon paint (Dotite, produced by Fujikura Kasei), 50 parts by weight of a melamine resin (Super Beckamin, produced by Dainippon Ink), 5 parts by weight of aluminum oxide powder (mean particle size 5 μm) and 15 parts by weight of a spherical melamine resin fine powder (melamine-isocyanurate copolycondensate, specific gravity 1.5, mean particle size 4 μm) were mixed with a solvent of 100 parts by weight of toluene, and then the mixture was dispersed by a ball mill over 6 hours. The dispersion was applied on an aluminum cylinder according to the dipping method and thermally cured at 150° C. over 30 minutes to provide an electroconductive layer to the film thickness of 20 μm.

Next, as the polyurethane resin 5 parts of Nipporane 800 (produced by Nippon Polyurethane K.K.) and 5 parts of Coronate 2507 (produced by Nippon Polyurethane K.K.) together with 0.01 part of a curing agent (dibutyltin laurate) were dissolved in 150 parts of methyl ethyl ketone, and the solution was applied by dipping on the above electroconductive layer and dried by heating at 150° C. for 30 minutes to obtain an adhesive layer.

Next, in the charge generation layer in Example 5, 6 parts of a cellulose acetate butyrate resin (trade name: CAB-381, produced by Eastman Kagaku) were added in place of the polyester resin to form a charge generation layer.

The charge transport layer was prepared in the same manner as in Example 5 to obtain an electrophotographic photosensitive member No. 21.

Evaluation of the photosensitive member was conducted in the same manner as in Example 5 to obtain the results shown in Table 4.

COMPARATIVE EXAMPLE 14

An electrophotographic photosensitive member No. 22 was prepared in the same manner as in Example 8 except for changing the mean particle size of the spherical melamine resin fine powder to 8.0 μm in the electroconductive layer in Example 8.

Evaluation of the photosensitive member was conducted in the same manner as in Example 5 to obtain the results shown in Table 4.

COMPARATIVE EXAMPLE 15

Except for providing no electroconductive layer in Example 5, the adhesive layer, the charge generation layer, the charge transport layer were successively formed on the aluminum cylinder in the same manner as in Example 5 to form an electrophotographic photosensitive member No. 23.

Evaluation of the photosensitive member was conducted in the same manner as in Example 5 to obtain the results shown in Table 4.

COMPARATIVE EXAMPLE 16

An electrophotographic photosensitive member No. 24 was prepared in the same manner as in Example 5 except for using a polyethylene with particle sizes of 20 to 30 μm which were crushed by a colloid mill to a mean particle size of 5.5 μm as the resin particles with irregular shapes in place of the spherical resin particles.

EXAMPLE 9

An electrophotographic photosensitive member No. 25 was prepared in the same manner as in Example 5 except for changing the aluminum cylinder to one of 80 mm in diameter and 360 mm in length in Example 5.

The photosensitive member No. 25 was mounted on a color copying machine (Color Laser Copyer 1, produced by Canon) to effect image formation.

When the image qualities at the initial stage and after successive copying of 10,000 sheets were investigated, gradation and high resolution were constantly maintained from the initial stage to 10,000 sheets, and color images of high quality without dot, fog and interference fringe could be obtained.

On the other hand, in the case of a photosensitive member containing no spherical resin fine powder, interference fringe occurred in a thin half tone image to give remarkably bad image quality. On the other hand, in the case of a photo-sensitive member containing spherical resin powder with the mean particle size of 7 μm or more, no interference fringe was recognized, but a larger number of black dots, pinholes, etc., were generated due to coating defects of CGL based on irregular unevenness of the electroconductive layer, etc.

EXAMPLE 10

100 parts of an electroconductive titanium oxide powder (produced by Titanium Kogyo K.K.), 100 parts of titanium oxide powder (produced by Sakai Kogyo K.K.), and 125 parts of a phenol resin (trade name: Plyophen, produced by Ink K.K.) were mixed with solvents of 50 parts of methanol and 50 parts of methyl cellosolve, and the mixture was then dispersed by a ball mill over 6 hours. The dispersion was applied on an aluminum cylinder of 60 mm in diameter and 260 mm in length according to the dip coating method and thermally cured at 150° C. for 30 minutes to provide an electroconductive layer with a film thickness of 20 μm.

Next, 20 parts of a copolymer nylon (trade name: Amilan CM-8000, produced by Toray K.K.) were dissolved in a mixture of 60 parts of methanol and 40 parts of butanol. Into the solution containing the copolymer nylon dissolved therein, 15 wt.% based on the copolymer nylon of a spherical silicone resin fine powder with a mean particle size of 0.8 μm was mixed and the mixture was dispersed by a propeller stirring machine for 2 hours. The dispersion was applied on the above electroconductive layer and dried in hot air at 50° C. for 20 minutes to form an adhesive layer with a thickness of 3 μm.

Next, 100 parts of an ε-type copper phthalocyanine (produced by Dai Nippon Ink K.K.), 50 parts of a butyral resin (produced by Sekisui Kagaku K.K.) and 1350 parts of cyclohexane were dispersed by use of a sand mill device by use of glass beads of 1 mm in diameter. To the dispersion were added 2700 parts of methyl ethyl ketone, and the mixture was applied by dipping on the above adhesive layer and dried under heating at 50° C. for 10 minutes to provide a charge generation layer with a coated amount of 0.15 g/m$^2$.

Subsequently, 10 parts of p-diethylaminobenzaldehyde-N-β-naphthyl-N-phenylhydrazone and 15 parts of styrene-methyl methacrylate copolymer (trade name: MS200, produced by Seitetsu Kagaku K.K.) were dissolved in 80 parts of toluene. The solution was applied on the above charge generation layer and dried in hot air at 100° C. for 1 hour to form a charge transport layer with a thickness of 16 μm.

The thus prepared laminated type photosensitive member No. 26 was mounted on a laser printer experimental machine having a gallium-aluminum-arsenic semiconductor laser (oscillation wave length 780 nm, output 5 mW) and provided with a corona charger (charging is negative), developer, transfer charger and a cleaner. As the result, an image with uniform image density at the solid image portion and sharp line image was obtained.

Also, evaluation of the photosensitive member was conducted similarly as in Example 1 to obtain the results shown in Table 5.

EXAMPLE 11

An electroconductive layer was coated according to the same method as in Example 10, and 20 parts of a phenol resin (trade name: Plyophen J-325, produced by Dainippon Ink K.K.), 5 parts of a butyral resin (trade name: Eslec B, BH-3, produced by Sekisui Kagaku K.K.) were dissolved in a mixture of 60 parts of methanol and 30 parts of butanol. In this solution, 12 wt.% based on the mixture of the phenol resin and butyral resin of a spherical silicone resin fine powder with a mean particle size of 1 μ was mixed, and the mixture was dispersed by a ball mill for 2 hours. The dispersion was applied on the above electroconductive layer and dried in hot air at 150° C. for 30 minutes to form an adhesive layer with a thickness of 5 μ.

Subsequently, the charge generation layer and the charge transport layer were formed in the same manner as in Example 10.

When image formation was effected according to the same method as in Example 1 for this electrophotographic photosensitive member No. 27, the image density at the solid image portion was uniform. At the line image, also a sharp image was obtained.

Also evaluation of the photosensitive member was conducted similarly as in Example 5 to obtain the results shown in Table 5.

EXAMPLE 12

In the adhesive layer in Example 11, a spherical acrylic resin fine powder with a mean particle size of 2.0 μm was used in place of the spherical silicone resin fine powder, and following otherwise the same procedure as in Example 11, an electrophotographic photosensitive member No. 28 was prepared. Evaluation of the photosensitive member was conducted in the same manner as in Example 5 to obtain the results shown in Table 5.

COMPARATIVE EXAMPLE 17

Except for omitting the silicone resin fine powder in the adhesive layer in Example 10, the electroconductive layer, the adhesive layer, the charge generation layer and the charge transport layer were coated according to the same method as in Example 10 to prepare an electrophotographic photosensitive member No. 29.

The photosensitive member No. 29 was mounted on the same laser printer experimental machine as described above to effect image formation, whereby there was no problem in line image, but density irregularity was generated by interference on the solid image portion.

COMPARATIVE EXAMPLE 18

In the adhesive layer in Example 10, 10 wt.% of zinc oxide powder (mean particle size 2 μm) was mixed into the resin used in Example 10 in place of the spherical silicon resin fine powder, and after coating, drying was conducted in hot air at 50° C. for 20 minutes to provide an adhesive layer with a thickness of 5 μm on the same electroconductive layer as in Example 10. Further, on the adhesive layer were provided the charge generation layer and the charge transport layer similarly as in Example 10 to prepare an electrophotographic photosensitive member No. 30. As the result of image formation on the photosensitive member No. 30 according to the same method as in Example 10, although no density irregularity by interference was seen on the solid image portion, when successive copying was performed continuously for 500 sheets by use of this photosensitive member, black dots by pinholes appeared.

Also, evaluation of the photosensitive member was conducted in the same manner as in Example 5 to obtain the results shown in Table 5.

COMPARATIVE EXAMPLE 19

In the adhesive layer in Example 10, a silicone resin fine powder (mean particle size 0.8 μm) with a spherical degree of 0.3 was used in place of the spherical silicone resin fine powder, and following otherwise the same procedure as in Example 10, an electrophotographic photosensitive member No. 31 was prepared.

Evalution of the photosensitive member was conducted in the same manner as in Example 5 to obtain the results shown in Table 5.

EXAMPLE 13

20 parts of a copolymer nylon (trade name: Amilan CM-8000, produced by Toray K.K.) were dissolved in a mixture of 60 parts of methanol and 40 parts of butanol. In the solution having the copolymer nylon dissolved therein, 15 wt.% based on the copolymer nylon of a spherical silicon resin fine powder with a mean particle size of 1.0 μm was mixed, and the mixture dispersed by a propeller stirring machine for 2 hours. The dispersion was applied on an aluminum cylinder of 60 mm in diameter and 260 mm in length and dried in hot air at 50° C. for 20 minutes to form an adhesive layer with a thickness of 3 μm. Next, on the adhesive layer the charge generation layer and the charge transport layer were provided in the same manner as in Example 10.

The photosensitive member No. 32 thus prepared was evaluated similarly as in Example 5 to obtain the results shown in Table 6.

COMPARATIVE EXAMPLE 20

An electrophotographic photosensitive member No. 33 was prepared in the same manner as in Example 13 except for using a silicone resin fine powder (mean particle size 1.0 μm) with a spherical degree of 0.3 in place of the spherical silicone resin fine powder in the adhesive layer in Example 13. Also, the photosensitive member was evaluated similarly as in Example 5 to obtain the results shown in Table 6.

COMPARATIVE EXAMPLE 21

An electrophotographic photosensitive member No. 34 was prepared in the same manner as in Example 13 except for omitting the spherical silicon resin fine powder in the adhesive layer in Example 13. Also, the photosensitive member was evaluated in the same manner as in Example 5 to obtain the results shown in Table 6.

TABLE 1

| Example | Example 1 | Example 2 | Comparative example 1 | Comparative example 2 |
|---|---|---|---|---|
| Photosensitive member No. | No. 1 | No. 2 | No. 3 | No. 4 |
| Spherical fine powder (spherical degree) | Silicone resin (0.9) | Silicone resin (0.8) | None | Silicone resin (0.7) |
| Mean particle size | 1.2 μm | 3.8 μm | — | 0.5 μm |
| Electroconductive layer: | | | | |
| Ten point average surface roughness: | 0.7 μm | 1.5 μm | 0.3 μm | 0.3 μm |
| Maximum surface height: | 1.0 μm | 2.0 μm | 0.5 μm | 0.6 μm |
| Coated surface | Uniform | Uniform | Uniform | Uniform |
| Initial image quality | High resolution, no black dot, no white dot, no fog | High resolu- no black dot, no white dot, no fog | High resolu- no black dot, no white dot, no fog | Slightly low resolution, much white dots |
| Image quality after 50,000 sheets of successive copying | No abnormality | No abnormality | Image defect by crack, fracture at end of photosensitive drum | Image defect by crack |
| Initial: | | | | |
| Dark potential: | −700 V | −690 V | −700 V | −690 V |
| Exposure potential: | −200 V | −190 V | −180 V | −190 V |
| After 50,000 sheets of successive copying: | | | | |
| Dark potential: | −680 V | −670 V | −690 V | −680 V |
| Exposure potential: | −230 V | −220 V | −240 V | −260 V |
| Stability of coating solution for electroconductive | No problem after one month | No problem after one month | No problem after one month | Particles agglomerated after 3 weeks |

TABLE 1-continued layer

| Example | Comparative example 3 | Comparative example 4 | Comparative example 5 |
|---|---|---|---|
| Photosensitive member No. | No. 5 | No. 6 | No. 7 |
| Spherical fine powder (spherical degree) | Silicone resin (0.8) | Zinc oxide (non-spherical) | Silicone resin (0.3) |
| Mean particle size | 7 μm | 3.8 μm | 1.8 μm |
| Electroconductive layer: | | | |
| Ten point average surface roughness: | 5.5 μm | 4.2 μm | 3.3 μm |
| Maximum surface height: | 8.0 μm | 6.5 μm | 8.0 μm |
| Coated surface | Great coarseness, coating irregularity generated | Great coarseness | Great coarseness |
| Initial image quality | Low resolution, much white dots, slightly fogged | Low resolution, much white dots, fogged | Low resolution, much white dots, fogged |
| Image quality after 50,000 sheets of successive copying | Increased white dots, black dots generated, density lowered | Increased white dots, black dots generated, fog worsened, density lowered | Increased white dots, black dots generated, fog worsened |
| Initial: | | | |
| Dark potential: | −720 V | −650 V | −680 V |
| Exposure potential: | −195 V | −170 V | −160 V |
| After 50,000 sheets of successive copying: | | | |
| Dark potential: | −500 V | −500 V | −520 V |
| Exposure potential: | −150 V | −310 V | −320 V |
| Stability of coating solution for electroconductive | No problem after one month | Particles sedimented, solution conc. became nonuniform in 3 days | Particles sedimented in 3 days |

TABLE 2

| Example | Example 3 | Comparative example 6 | Example 4 | Comparative example 7 | Comparative example 8 |
|---|---|---|---|---|---|
| Photosensitive member No. | No. 8 | No. 9 | No. 10 | No. 11 | No. 12 |
| Spherical fine powder (spherical degree) | Styrene type resin (0.8) | None | Melamine resin (0.7) | Melamine resin (0.7) | None |
| Mean particle size | 1.0 μm | — | 3.0 μm | 7.1 μm | — |
| Electroconductive layer: | | | | | |
| Ten point average surface roughness: | 0.8 μm | 0.3 μm | 2.0 μm | 4.5 μm | 0.2 μm |
| Maximum surface height: | 2.2 μm | 0.7 μm | 3.4 μm | 6.9 μm | 0.3 μm |
| Coated surface | Uniform | Uniform | Uniform | Coating irregularity generated | Uniform |
| Initial image quality | High resolution, no black dot and white dot, no fog | High resolution, no black dot and white dot, no fog | High resolution, no black dot and white dot, no fog | Low resolution, white dots present | White dots, black streaks and fog present |
| Image quality after 50,000 sheets of successive copying | No abnormality | Image defect by crack, fracture at end of photosensitive drum | No abnormality | Increased white dots, black dots generated, pinholes generated | Black streaks and fog present, increased black and white dots, pinholes generated |
| Initial: | | | | | |
| Dark potential: | −710 V | −700 V | −690 V | −680 V | −720 V |
| Exposure potential: | −210 V | −220 V | −200 V | −210 V | −220 V |
| After 50,000 sheets of successive copying: | | | | | |
| Dark potential: | −690 V | −720 V | −700 V | −570 V | −610 V |
| Exposure potential: | −260 V | −280 V | −260 V | −280 V | −290 V |
| Stability of coating solution for | No problem after one | No problem after one | No problem after one | No problem after one | |

TABLE 2-continued

| Example | Example 3 | Comparative example 6 | Example 4 | Comparative example 7 | Comparative example 8 |
|---|---|---|---|---|---|
| electroconductive layer | month | month | month | month | |

TABLE 3

| Example | Example 5 | Example 6 | Comparative example 9 | Comparative example 10 | Comparative example 11 | Comparative example 12 |
|---|---|---|---|---|---|---|
| Photosensitive member No. | No. 13 | No. 14 | No. 15 | No. 16 | No. 17 | No. 18 |
| Spherical fine powder (spherical degree) | Silicone resin (0.9) | Silicone resin (0.9) | None | Silicone resin (0.8) | Silicone resin (0.7) | Zinc oxide (0.3) |
| Mean particle size | 2.0 μm | 4.0 μm | — | 0.4 μm | 8.0 μm | 4.0 μm |
| Electroconductive layer: | | | | | | |
| Ten point average surface roughness: | 1.5 μm | 1.9 μm | 0.3 μm | 0.3 μm | 6.5 μm | 4.5 μm |
| Maximum surface height: | 1.8 μm | 2.1 μm | 0.5 μm | 0.6 μm | 9.2 μm | 7 μm |
| Coated surface | Uniform | Uniform | Uniform | Uniform | Coating irregularity generated | Nonuniform coarseness present |
| Initial image quality | High resolution, no black dot and white dot, no fog, no interference fringe | High resolution, no black dot and white dot, no fog, no interference fringe | No black dot and white dot, no fog, interference fringe present | No black dot and white dot, no fog, interference fringe present | Low resolution, much black dots | Low resolution, much black dots, fog present |
| Image quality after 50,000 sheets of successive copying | No abnormality | No abnormality | Black dots generated, image defect by crack, fracture at end of photosensitive drum | Black dots generated, image defect by crack | Increased black dots, white dots generated, pinholes generated | Increased black dots, white dots generated, fog worsened |
| Initial: | | | | | | |
| Dark potential: | −700 V | −690 V | −680 V | −710 V | −720 V | −670 V |
| Exposure potential: | −105 V | −110 V | −120 V | −110 V | −130 V | −160 V |
| After 50,000 sheets of successive copying: | | | | | | |
| Dark potential: | −750 V | −740 V | −720 V | −760 V | −610 V | −410 V |
| Exposure potential: | −200 V | −190 V | −190 V | −200 V | −100 V | −200 V |
| Stability of coating solution for electroconductive layer | No problem after one month | No problem after one month | No problem after one month | Particles agglomerated after 3 weeks | No problem after one month | Particles agglomerated after 3 days |

TABLE 4

| Example | Example 7 | Comparative example 13 | Example 8 | Comparative example 14 | Comparative example 15 | Comparative example 16 |
|---|---|---|---|---|---|---|
| Photosensitive member No. | No. 19 | No. 20 | No. 21 | No. 22 | No. 23 | No. 24 |
| Spherical fine powder (spherical degree) | Acrylic resin (0.8) | None | Melamine resin (0.7) | Melamine resin (0.7) | None | Polyethylene (Non-spherical) |
| Mean particle size | 1.5 μm | — | 4.8 μm | 8.0 μm | — | 5.5 μm |
| Electroconductive layer: | | | | | | |
| Ten point average surface roughness: | 1.1 μm | 0.3 μm | 3.0 μm | 6.9 μm | 0.2 μm | 4.9 μm |
| Maximum surface height: | 1.5 μm | 0.5 μm | 4.9 μm | 7.9 μm | 0.4 μm | 8.2 μm |
| Coated surface | Uniform | Uniform | Uniform | Coating irregularity generated | Uniform | Nonuniform coarseness present |
| Intial quality | High resolution, no black dot and white dot, no fog, no interference fringe | No black dot and white dot, no fog, interference fringe present | High resolution, no black dot and white dot, no fog, no interference fringe | Low resolution, black dots and fog present, no interference fringe | Black dots, white streaks, fog and interference fringe present | Much black dots, fog present |
| Image quality after 50,000 sheets of successive copying | No abnormality | Black dots generated, image defect by crack, | Fine black dots generated without practical problem | Increased black dots, white dots generated, pinholes gener- | Increased white streaks, increased fog, black dots, | Increased black dots, increased fog |

TABLE 4-continued

| Example | Example 7 | Comparative example 13 | Example 8 | Comparative example 14 | Comparative example 15 | Comparative example 16 |
|---|---|---|---|---|---|---|
| | | fracture at end of photosensitive drum | | ated | white dots generated, image defect by crack | |
| Initial: | | | | | | |
| Dark potential: | −710 V | −700 V | −700 V | −690 V | −705 V | −710 V |
| Exposure potential: | −130 V | −170 V | −120 V | −125 V | −180 V | −195 V |
| After 50,000 sheets of successive copying: | | | | | | |
| Dark potential: | −720 V | −730 V | −650 V | −500 V | −750 V | −620 V |
| Exposure potential: | −210 V | −250 V | −190 V | −105 V | −290 V | −210 V |
| Stability of coating solution for electro-conductive layer | No problem after one month | No problem after one month | No problem after one month | No problem after one month | | Agglomeration occurred in coating solution in 3 days |

TABLE 5

| Example | Example 10 | Example 11 | Example 12 | Comparative example 17 | Comparative example 18 | Comparative example 19 |
|---|---|---|---|---|---|---|
| Photosensitive member No. | No. 26 | No. 27 | No. 28 | No. 29 | No. 30 | No. 31 |
| Spherical fine powder (spherical degree) | Silicone resin (0.9) | Silicone resin (0.8) | Acrylic resin (0.7) | — — | Zinc oxide (Non-spherical) | Silicone resin (0.3) |
| Mean particle size | 0.8 μm | 1.0 μm | 2.0 μm | — | 2 μm | 0.8 μm |
| Adhesive layer | | | | | | |
| Ten point average surface roughness: | 0.5 μm | 0.6 μm | 0.9 μm | 0.1 μm | 1.2 μm | 1.0 μm |
| Maximum surface height: | 0.6 μm | 0.7 μm | 1.0 μm | 0.2 μm | 3.5 μm | 3.0 μm |
| Coated surface | Uniform | Uniform | Uniform | Uniform | Great coarseness | Great coarseness |
| Initial image quality | High resolution, no black dot and white dot, no fog, no interference fringe | High resolution, no black dot and white dot, no fog, no interference fringe | High resolution, no black dot and white dot, no fog, no interference fringe | No black dot and white dot, no fog, interference fringe present | Black dots and white dots present, fog present, no interference fringe | Black dots and fog present, no interference fringe |
| Image quality after 50,000 sheets of successive copying | No abnormality | No abnormality | No abnormality | Image defect by crack, fracture at end of photosensitive drum | Increased white dots, increased black dots, fog worsened, density lowered | White dots generated, increased black dots, fog worsened, density lowered |
| Initial: | | | | | | |
| Dark potential: | −710 V | −720 V | −710 V | −710 V | −700 V | −700 V |
| Exposure potential: | −150 V | −140 V | −160 V | −180 V | −170 V | −150 V |
| After 50,000 sheets of successive copying: | | | | | | |
| Dark potential: | −700 V | −690 V | −730 V | −720 V | −590 V | −650 V |
| Exposure potential: | −170 | −180 V | −220 V | −250 V | −290 V | −250 V |
| Stability of coating solution for adhesive layer | No problem after one month | No problem after one month | No problem after one month | No problem after one month | Particles agglomerated, solution conc. becam nonuniform in 3 days | Particles agglomerated in 3 days |

TABLE 6

| Example | Example 13 | Comparative example 20 | Comparaive example 21 |
|---|---|---|---|
| Photosensitive member No. | No 32 | No. 33 | No. 34 |
| Spherical fine powder (spherical degree) | Silicone resin (0.9) | Silicone resin (0.3) | — |
| Mean particle size | 1.0 m | 1.0 m | — |
| Adhesive layer: | | | |
| Ten point average surface roughness: | 0.6 μm | 1.2 μm | 0.1 μm |
| Maximum surface height: | 0.7 μm | 3.1 μm | 0.2 μm |
| Coated surface | Uniform | Great coarseness | Uniform |
| Initial image | High resolu- | Black dots | No black dot, |

TABLE 6-continued

| Example | Example 13 | Comparative example 20 | Comparaive example 21 |
|---|---|---|---|
| quality | tion, no black dot and white dot, no fog, no interference fringe | present, fog present, no interference fringe | white dot, no fog, interference fringe present |
| Image quality after 50,000 sheets of successive copying | No abnormality | White dots generated, increased black dots, fog worsened, density lowered | Image defect by crack, fracture at end of photosensitive drum |
| Initial: | | | |
| Dark potential: | −710 V | −700 V | −710 V |
| Exposure potential: | −160 V | −150 V | −180 V |
| After 50,000 sheets of successive copying: | | | |
| Dark potential: | −690 V | −640 V | −720 V |
| Exposure potential: | −180 V | −250 V | −250 V |
| Stability of coating solution for adhesive layer | No problem after one month | Particles agglomerated in 3 days | No problem after one month |

What is claimed is:

1. An electrophotographic photosensitive member comprising an intermediate layer between a support and a photosensitive layer, wherein said intermediate layer contains spherical resin fine powder, said spherical resin fine powder:

(a) having a mean particle size of 0.6 to 6 microns;

(b) having a spherical degree of 0.5 or more in terms of ratio of the diameter of the minimum circumscribed circle to the diameter of the maximum inscribed circle when the diameter of the circumscribed circle is 1;

(c) being present in amounts from 0.5 to 30 weight percent based on the total weight of the intermediate layer.

2. An electrophotographic photosensitive member according to claim 1, wherein the spherical degree of the spherical resin fine powder is 0.8 or more.

3. An electrophotographic photosensitive member according to claim 1, wherein the spherical resin fine powder is selected from the group consisting of acrylic resin, styrene resin, polycarbonate, polyester, polyamide, silicone resin, melamine resin and urea resin.

4. An electrophotographic photosensitive member according to claim 1, wherein the spherical resin fine powder is selected from the group consisting of silicone resin, melamine resin, polyamide, acrylic resin and styrene resin.

5. An electrophotographic photosensitive member according to claim 1, wherein the spherical resin fine powder is silicone resin.

6. An electrophotographic photosensitive member according to claim 1, wherein the intermediate layer containing the spherical resin fine powder is an electroconductive layer.

7. An electrophotographic photosensitive member according to claim 6, wherein the spherical degree of the spherical resin fine powder is 0.8 or more.

8. An electrophotographic photosensitive member according to claim 6, wherein the spherical resin fine powder is selected from the group consisting of acrylic resin, styrene resin, polycarbonate, polyester, polyamide, silicone resin, melamine resin and urea resin.

9. An electrophotographic photosensitive member according to claim 6, wherein the spherical resin fine powder is selected from the group consisting of silicone resin, melamine resin, polyamide, acrylic resin and styrene resin.

10. An electrophotographic photosensitive member according to claim 6, wherein the spherical resin fine powder is silicone resin.

11. An electrophotgraphic photosensitive member according to claim 1, wherein the intermediate layer containing the spherical resin fine powder is an adhesive layer.

12. An electrophotographic photosensitive member according to claim 11, wherein the spherical degree of the spherical resin fine powder is 0.8 or more.

13. An electrophotographic photosensitive member according to claim 11, wherein the spherical resin fine powder is selected from the group consisting of acrylic resin, styrene resin, polycarbonate, polyester, polyamide, silicone resin, melamine resin and urea resin.

14. An electrophotographic photosensitive member according to claim 11, wherein the spherical resin fine powder is selected from the group consisting of silicone resin, melamine resin, polyamide, acrylic resin and styrene resin.

15. An electrophotographic photosensitive member according to claim 11, wherein the spherical resin fine powder is silicone resin.

16. An electrophotographic photosensitive member according to claim 1, wherein the intermediate layer has a laminated structure of an electroconductive layer and an adhesive layer, and the spherical resin fine powder is contained in either of the electroconductive layer or the adhesive layer.

17. An electrophotographic photosensitive member according to claim 16, wherein the spherical degree of the spherical resin fine powder is 0.8 or more.

18. An electrophotographic photosensitive member according to claim 16, wherein the spherical resin fine powder is selected from the group consisting of acrylic resin, styrene resin, polycarbonate, polyester, polyamide, silicone resin, melamine resin and urea resin.

19. An electrophotographic photosensitive member according to claim 16, wherein the spherical resin fine powder is selected from the group consisting of silicone resin, melamine resin, polyamide, acrylic resin and styrene resin.

20. An electrophotographic photosensitive member according to claim 16, wherein the spherical resin fine powder is silicone resin.

21. An electrophotographic photosensitive member according to claim 1, wherein the photosensitive layer has a laminated structure of a charge generation layer and a charge transport layer.

* * * * *

UNITED STATES PATENT AND TRADEMARK OFFICE

CERTIFICATE OF CORRECTION

PATENT NO. : 4,948,690

DATED : August 14, 1990

INVENTOR(S) : MASAFUMI HISAMURA, ET AL.

It is certified that error appears in the above-identified patent and that said Letters Patent is hereby corrected as shown below:

COVER PAGE

[56], References Cited, after "U.S. Patent Documents", insert

--3,656,949 4/1972 Honjo et al. .....430/62
4,308,332 12/1981 Upson et al. .....430/62
4,106,935 8/19/78 Petruzzella .....430/64--

After "Foreign Patent Documents", insert

--60-52857 3/1985 Japan

COLUMN 1

Line 44, "are" should read --as--;
Line 58, "la" should read --a--; and
Line 65, "getter" should read --better--.

COLUMN 2

Line 12, "damages, striken" should read --damage, strike--; and
Line 25, "damages, striken" should read --damage, strike--.

COLUMN 3

Line 5, "rather" should read --the resulting--;
Line 45, "eacy" should read --easy--; and

UNITED STATES PATENT AND TRADEMARK OFFICE

CERTIFICATE OF CORRECTION

PATENT NO. : 4,948,690

DATED : August 14, 1990

INVENTOR(S) : MASAFUMI HISAMURA, ET AL.

It is certified that error appears in the above-identified patent and that said Letters Patent is hereby corrected as shown below:

Line 50, "or" (first occurrence) should read --of--.

COLUMN 4

Line 9, "even when" should read --even after--; and
Line 17, "ages," should read --age,--.

COLUMN 5

Line 27, "strange subject," should read --ghosts--; and
Line 29, "fine strange subject" should read --fine ghosts--.

COLUMN 6

COLUMN 7

Line 13, "or" should read --of--; and
Line 14, "aminocarproic" should read --aminocaproic--.

COLUMN 8

Line 16, "allyos," should read --alloys,--;
Line 30, "meyer nad" should read --Meyer bar--;
Line 33, "electroconductive" should read --electroconductive substance. The film thickness of the electroconductive--; and
Line 51, "copolyers" should read --copolymers--.

UNITED STATES PATENT AND TRADEMARK OFFICE

CERTIFICATE OF CORRECTION

PATENT NO. : 4,948,690

DATED : August 14, 1990

INVENTOR(S) : MASAFUMI HISAMURA, ET AL.

It is certified that error appears in the above-identified patent and that said Letters Patent is hereby corrected as shown below:

COLUMN 10

Line 29, "substance" should read --substances--.

COLUMN 11

Line 16, "by" should read --of--;
Line 37, "diameterfor" should read --diameter--; and
Line 43, "0.1 $g/m^3$" should read --0.1 $g/m^2$--.

COLUMN 14

Line 31, "Dainippoin" should read --Dainippon--.

COLUMN 17

Line 22, "Evalution" should read --Evaluation--; and
Line 32, "Evalution" should read --Evaluation--.

COLUMN 19

Line 34, "Ink K.K.)" should read --Dainippon Ink K.K.)--.

UNITED STATES PATENT AND TRADEMARK OFFICE

CERTIFICATE OF CORRECTION

PATENT NO. : 4,948, 690

DATED : August 14, 1990

INVENTOR(S) : Masafumi Hisamura, et al.

It is certified that error appears in the above-identified patent and that said Letters Patent is hereby corrected as shown below:

COLUMN 19

Line 34, "Ink K.K.)" should read --Dainippon Ink K.K.)--.

Signed and Sealed this

Fifteenth Day of September, 1992

*Attest:*

DOUGLAS B. COMER

*Attesting Officer*

*Acting Commissioner of Patents and Trademarks*